US007726056B2

(12) United States Patent
Brodie

(10) Patent No.: US 7,726,056 B2
(45) Date of Patent: Jun. 1, 2010

(54) KNOCK DOWN SIGNPOST

(75) Inventor: Ian Charles Brodie, Victoria Point (AU)

(73) Assignee: JMB Manufacturing Pty Ltd., Victoria Point, Queensland (AU)

( * ) Notice: Subject to any disclaimer, the term of this patent is extended or adjusted under 35 U.S.C. 154(b) by 245 days.

(21) Appl. No.: 11/813,495

(22) PCT Filed: Jan. 9, 2006

(86) PCT No.: PCT/AU2006/000022

§ 371 (c)(1),
(2), (4) Date: Jul. 6, 2007

(87) PCT Pub. No.: WO2006/072146

PCT Pub. Date: Jul. 13, 2006

(65) Prior Publication Data

US 2008/0209784 A1 Sep. 4, 2008

(30) Foreign Application Priority Data

Jan. 10, 2005 (AU) ..... 2005900078

(51) Int. Cl.
*G09F 15/00* (2006.01)

(52) U.S. Cl. ..... 40/608; 40/607.08; 40/607.04; 404/10; 248/160

(58) Field of Classification Search ..... 40/608, 40/607.04; 52/831, 170
See application file for complete search history.

(56) References Cited

U.S. PATENT DOCUMENTS 1,679,623 A 8/1928 Olsen
3,485,201 A * 12/1969 Kelley ..... 116/63 P
3,693,940 A * 9/1972 Kendall et al. ..... 256/1
3,838,661 A * 10/1974 Medley, Jr. ..... 116/63 P
4,466,375 A * 8/1984 Marker ..... 114/90
4,729,690 A * 3/1988 Lavender et al. ..... 404/10
4,806,046 A 2/1989 Clark
5,199,814 A 4/1993 Clark et al.
5,492,429 A * 2/1996 Hodges ..... 403/372

(Continued)

FOREIGN PATENT DOCUMENTS

AU 766749 5/2000

(Continued)

*Primary Examiner*—Lesley Morris
*Assistant Examiner*—Kristina Staley
(74) *Attorney, Agent, or Firm*—Heslin Rothenberg Farley & Mesiti P.C.; Victor A. Cardona, Esq.

(57) ABSTRACT

There is provided a knock down signpost comprising a post member (6) and a lower body member (10) held together by a spring (3) having a preload when the post is vertical, acting two flat surfaces (8) creating an initial resistance to motion off the horizontal. Two steel cables (114) transmit the force of the spring and are spaced apart which allows the cables to act as a non rotation mechanism. Two round protrusions (16) in the post member (6) locate into two matching clearance holes (14) in the lower body for post alignment. A shock tube (4) is fitted over the cable and internal to the spring to prevent over compression and provides a mechanical stop. As the top assembly is rotated chamfered edges (15) of the post member (6) engage and interlock into an annular groove (13) to act as a pseudo-hinge.

19 Claims, 7 Drawing Sheets

U.S. PATENT DOCUMENTS 5,624,210 A * 4/1997 Baldwin et al. ..... 405/232
5,625,988 A * 5/1997 Killick ..... 52/298

FOREIGN PATENT DOCUMENTS

DE 9301135 U1 5/1993
EP 042810 A2 12/1981
WO 2005/017262 A1 2/2005

* cited by examiner

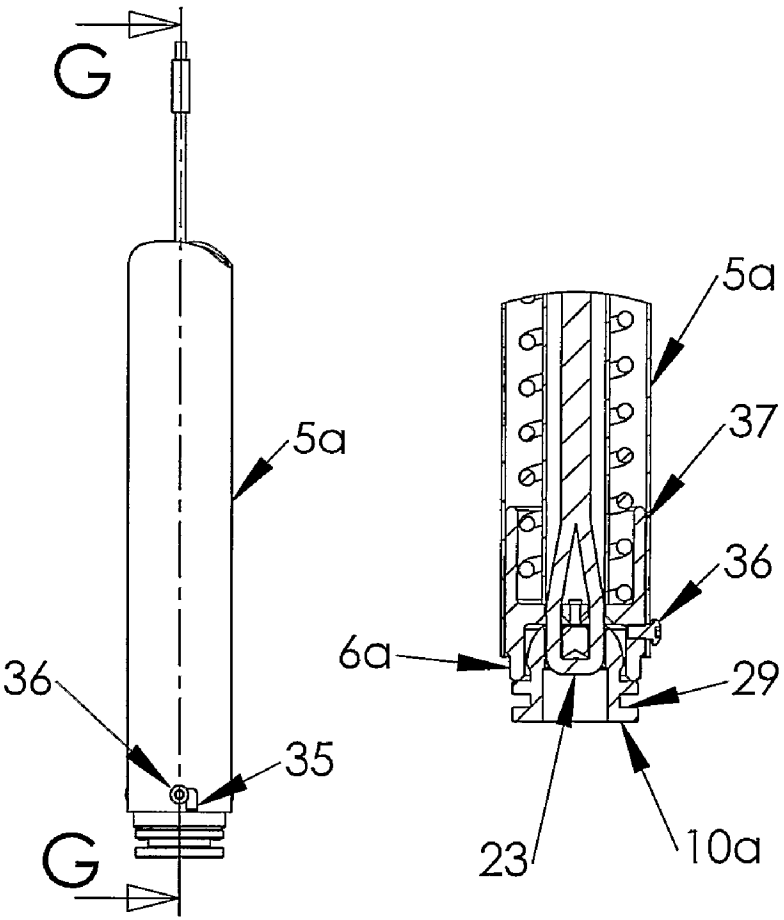
FIG 6B
FIG 6A
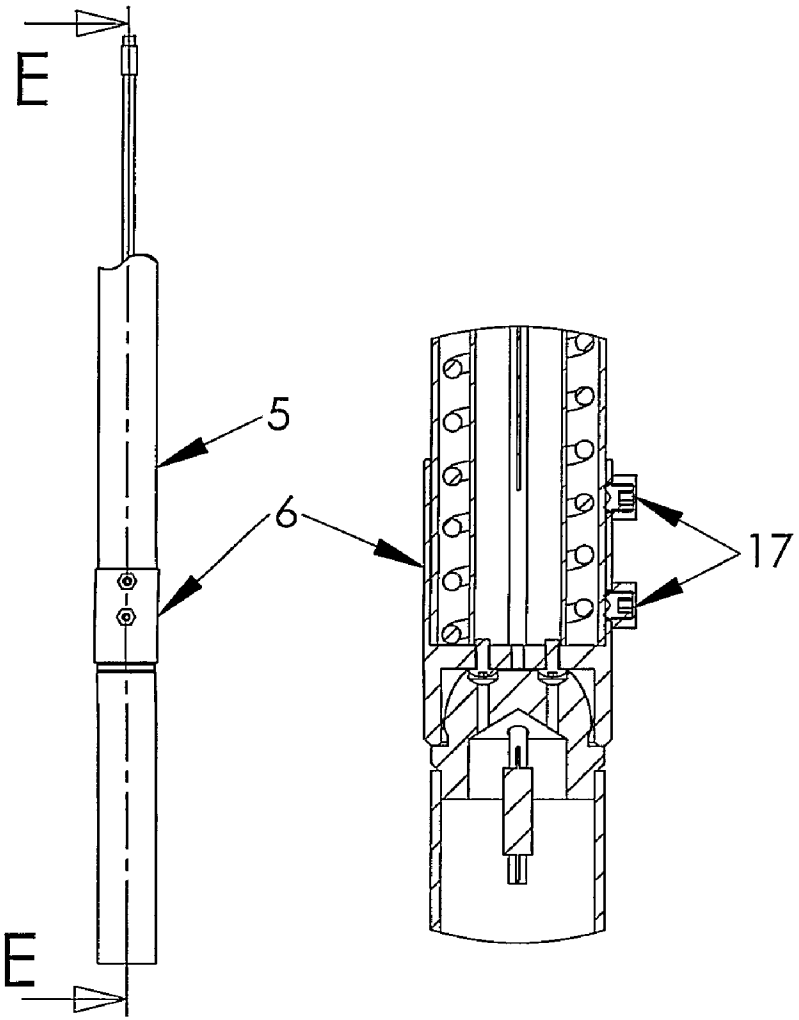
FIG 5B
FIG 5A

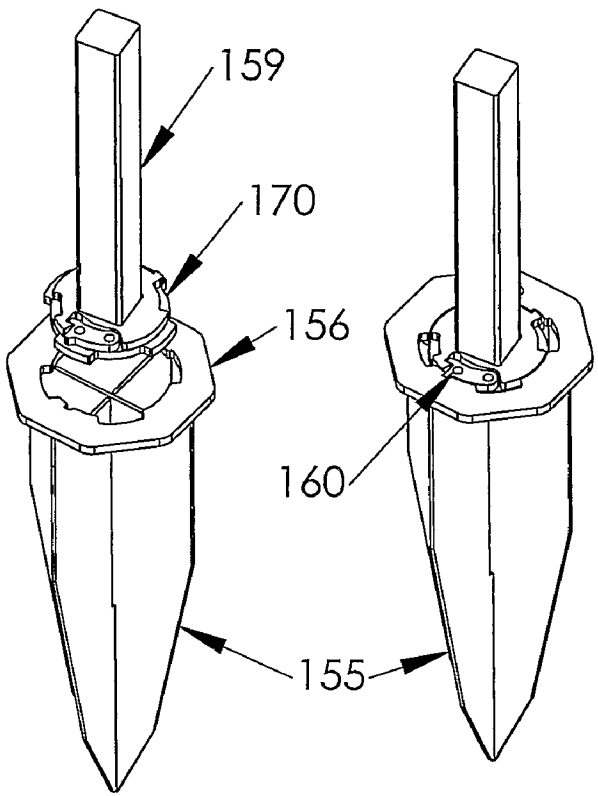
FIG 11A
FIG 11B
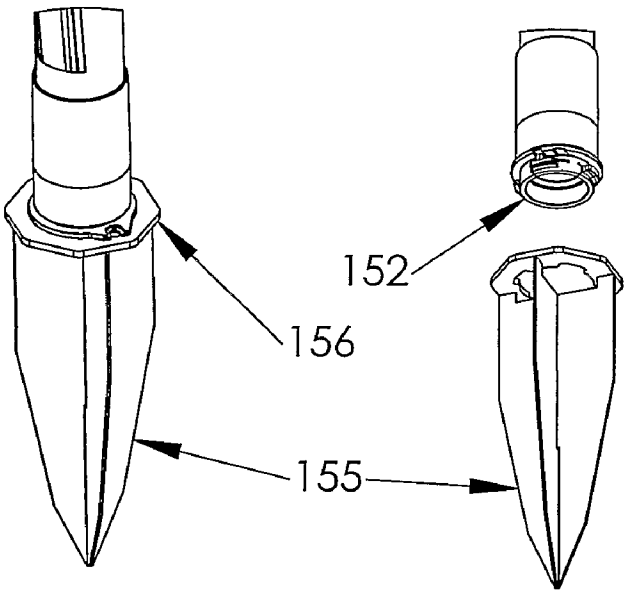
FIG 10A
FIG 10C
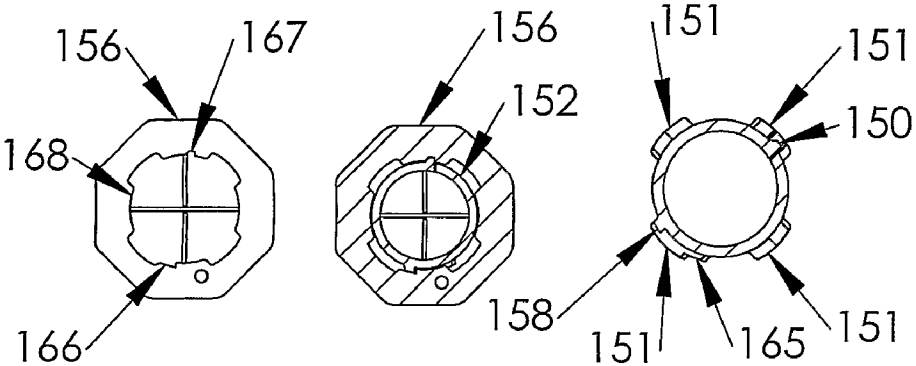
FIG 10B
FIG 10D
FIG 10E

KNOCK DOWN SIGNPOST

This invention relates to a knock down signpost.

This invention has particular application in respect of a substantially omnidirectional recoverably knock down signpost for a traffic island or other situation where occasional impacts are to be expected, and for illustrative purposes the invention will be further described with reference to this application. However, it is envisaged that the fundamental principles of the invention will find application in a wide range of different circumstances requiring a mounting base capable of being able to be recoverably knocked down from different directions.

Traffic island signage such as KEEP LEFT signs generally takes the form of a tubular signpost supporting a sign to be about 1600 mm high. Such signage at its simplest comprises a single piece 50 mm nominal bore (NB) pipe fixed to the substrate such as by direct concreting, wedged into a ground sleeve, or welded to a flange and bolted to the road or island. The 50 NB post is intended to bend or break during a collision and repair after a collision may then be by one or more of straightening, replacement of some or all of the assembly and repair of the road/island.

Spring-back or recovery signage is known and generally comprises one of two types. The first type is elastomer based products that use a block of rubber, polyurethane or the like at a fulcrum point. Upon collision the post travels toward the ground by way of the elastic deformation of the elastomer material. When released the post comes back to the vertical position. The second type are spring mechanical products which use a metal spring to provide the self righting force, and generally uses a mechanical mechanism for the fulcrum.

Both types utilize a lightweight, generally plastic post in order to reduce the inertia of the sprung mass. Accordingly the options of utilizing a low-cost steel post or high-strength high tensile post are not available. In order to imbue the apparatus with a low spring constant to control rebound energy, the current spring posts have a tendency to move under modest wind loading. No other product currently available can use a post longer than 1200 mm. With the exceptions described hereinafter, the current products must use either smaller signs or plastic signs to reduce their weight to a sufficient point that they will operate correctly. "Sign flutter" is the tendency of the sign to move around from either the wind generated by passing traffic or atmospheric wind. It is undesirable on the road as it makes signage difficult to read, can cause it to momentarily lean into the path of oncoming traffic, and in extreme cases of atmospheric wind, the sign can lean over into traffic lanes. Elastomer base products all suffer from this problem to some degree. Damage to the post usually requires the replacement of the entire assembly.

The present invention in one aspect resides broadly in a knock down signpost including:

a lower body member having an annular bearing surface bounding a spigot portion;

a post member having a lower annular edge corresponding to said annular bearing surface and bounding a recess adapted to receive said spigot, said spigot and recess being mutually configured to allow an articulation of said post member about an engagement of said lower annular edge and annular bearing surface in any direction, said spigot and recess having complementary indexing means adapted to circumferentially align said lower body member and said post member; and a flexible cable passing through said lower body member and said post member, one end of said cable being retained in one of said lower body member and said post member and said cable being pretensioned by tension means located in the other of said lower body member and said post member to urge said lower body and post members into mutual engagement against said articulation.

The lower body member may be mounted to the traffic island or substrate by any suitable means. For example the lower body member may be integral with or forming an assembly with a substrate engaging mounting spike, or other conventional mounting base. The lower body member may be configured to be grouted or cast directly into the concrete of a traffic island or the like, or may be configured for insertion into a preformed socket arrangement in the traffic island.

The spigot portion and/or recess may include means to constrain initial impact movement of the post member to minimize lateral displacement. This protects the cable and tension means from the initial shear forces of impact. This induced rotation is designed to minimise the damage of impact to both post and vehicle. By inducing post rotation, the energy suddenly imparted to the post from the impact, causes the posts travel to the horizontal position faster, meaning it is clear from further impact as the car passes over.

For example, the spigot portion may include an annular, part spherical surface of dimensions selected whereby an inner annular surface of the post member bounding the recess in the region of the lower annular edge is constrained to follow the part spherical surface for the initial displacement (for example, 5 to 10°) until the lower annular edge is fully engaged with the bearing surface for rotation. The annular, substantially part spherical surface preferably extends about the hemispheric plane of the notional sphere defining the surface. For example, for a 50 NB post member, the hemispheric plane may pass 5 to 10 mm above the plane of interaction of the lower annular edge and annular bearing surface.

The lower edge and bearing surface may be configured to enhance the nature of the mutual rotation and/or promote a more substantial (stable) locking engagement between the two elements. For example, the bearing surface may comprise an annular, curved surface. The lower edge may be correspondingly rounded.

The cable may comprise an axial single or multiplex cable. However, it is preferred that the cable comprise at least two spaced cables disposed equidistant the axis. Such multiple cable arrangements permit the cable to perform two distinct functions. Firstly, the primary function of the cables is to transmit the force of the tension means between the post member and the lower body member. The cables are always in tension. In the vertical position the cables transmit the pretension of the tension means forcing the post and lower body members together and thus providing initial resistance to rotation. During rotation of the post, the distance between the upper and lower elements increases. This causes the tension means to load up as the length of cable available in the post is reduced.

Secondly, the at least two cables, being spaced apart, act as a primary indexing means, forcing the post and lower body members to realign to their original orientation as the post returns to vertical.

The complementary indexing means of the spigot and recess adapted to circumferentially align the lower body member and the post member may take any suitable form such as complementary cam surfaces. For example, the positive realignment may be provided with at least two round protrusions in the recess adapted to locate into two matching clearance holes in the spigot. These elements may engage in the last few degrees of horizontal to vertical rotation after the cable has done the primary work.

The shape of the complementary indexing means are preferably selected whereby they do not take any shear force that may occur in the initial impact whilst any clearances between the elements are taken up.

The tension means may take any suitable means such as an elastomeric, metal or air spring. For simplicity it is envisaged that a metal coil spring will be most often used and the invention is described hereinafter with reference to the use of a coil spring. The spring preferably uses the lowest spring rating possible. This has the effect of minimising the force increase on the pivoting mechanism from the vertical to the horizontal position. This means as the post pivots further toward the horizontal, the apparent force weight of the post or (moment of the post) increases at a greater rate to that of the spring force. The result of this is that the force acting on the post at horizontal is reduced and the spring appears to lose force as it pivots. This effect reduces the speed and the force at which the sign post comes back up, so when a vehicle is travelling over the sign the force of the post hitting the underneath of the car from horizontal is greatly reduced, thus reducing the damage to both signage and vehicle.

The preload is may be set to resist a selected bending moment, for example, equal to that induced by a 100 km/h wind impinging on the sign, and is empirically determined.

The cables preferably pass through individual guide holes in the lower body and upper wall of the recess respectively. The guide holes may be relieved or chamfered to prevent the cables being squeezed and damage during the initial degrees of rotation of the upper element. Larger chamfering of the cable guide holes on upper wall of the recess in combination with smaller chamfering in the lower body cable guide holes are preferred. Due to the geometry of the pivoting joint, there is insufficient clearance between the upper and lower elements, causing the cable to be squeezed and extruded to a degree. This squeezing has the effect of distorting the cable and fracturing the outer strands. Without these features the cable increasingly frays with every joint cycle and eventually fails. The second function of the large chamfering in combination with the smaller chamfering on the matching lower body help prevent any cable shear that may occur from the lateral motion of the joint to take up any clearances between the upper and lower elements upon an initial impact.

A shock tube may be fitted over the cable and internal to the spring. The tube primary functions to prevent over compression and resulting damage to the spring should the upper element and post get hooked on a vehicle undercarriage. The tube provides a mechanical stop at a set distance of spring travel. The secondary function of the shock tube is to keep the spring straight when it is under compression, and not capture by the posts internal diameter. This feature is intended to facilitate the ease of quick post replacement by preventing the spring from forming its own random equilibrium shape when under tension.

There may be provided a plastic delineator apparatus, where the substantially U-shape connection system above is replaced by, for example, a multi-tab bayonet twist and lock system. The bayonet system may comprise a lower spigot associated with the post and having capture tabs adapted to engage clearance slots of a capture ring of an in-ground spike. There may be provided a unique feature on one of the equally-spaced tabs which corresponds to a feature of a particular clearance groove in the corresponding capture ring. This means the lower spigot can only be fed into the capture ring in the correct orientation for the guide post/delineator. Alternatively the tabs may be asymmetric to allow only one orientation of engagement.

Once the lower spigot is fitted through the capture it may be rotated until it locks into place. The locking mechanism may comprise any suitable means. For example, the locking means may include a stop lug that prevents over-rotation. At the stop limit, there may be provided a clip which has been flexed inward by the internal surface of the ring and is allowed to spring back out and is captured by a groove. Further rotation in either direction is prevented by both the engagement of stop lug which rests against the end of feature and the clip which is captured in feature. Removal may be effected by disengaging the clip to allow counter rotation out of the stop position until the lugs and slots are again aligned for removal.

For particularly tall delineators/guide posts, there may be provided a modified base adapted to accommodate the wind loading and inertial issues. For example, for tall knockdown posts of up to 2.8 m there is currently no available technology. The applicant has determined that to keep the spring forces realistic and relatively safe, the leverage system of the sleeve and spigot combination must be changed to give more leverage to pick up the 2.8 m steel post. For example the diameter of the sleeve and spigot may be increased therefore decreasing the leverage disadvantage, to keep the moment balance equation equal to that of the above-described apparatus, meaning that virtually the same spring can to pick up the longer post from the horizontal position.

The downside of the taller post with the same spring is that there is greatly reduced resistance to wind flutter in the vertical position. To overcome this there may be provided a plurality of equally spaced spring loaded detent latches to provide a selected initial resistance to movement. Once the detent is overcome on impact, the resistance to movement is removed. The return path of the top sleeve back over the lower spigot and detents may be by means of selecting the engagement angle to ensure the main spring pressure is sufficient to re engage the detent-latches once the post is upright again.

The invention will be further described with reference to the accompanying drawings illustrating preferred embodiments of the invention and wherein:

FIGS. 5A and 5B are is an elevation and section respectively of an outside sleeve post connection usable in the context of the present invention;

FIGS. 6A and 6B are an elevation and section respectively of a quick release bolted post connection usable in the context of the present invention;

FIGS. 10A to 10E are a perspective in assembly, plan view of ground spike, perspective exploded view, sectional plan through post bayonet portion and sectional plan through base bayonet portion, suitable for use with the apparatus of FIG. 9;

FIGS. 11A and 11B are exploded and assembled perspective views of a driving tool for the spike as used in the apparatus of FIG. 10.

Figure 1:
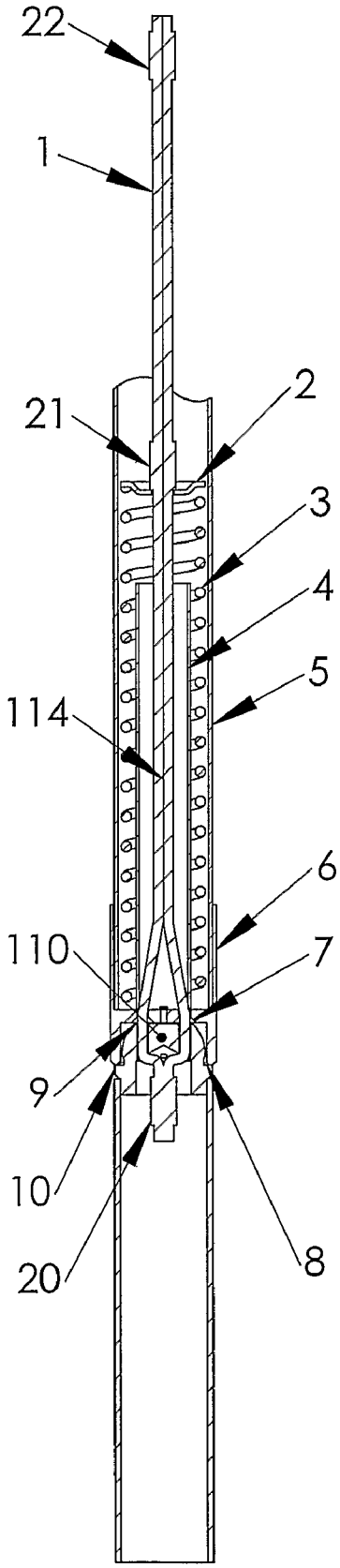
FIG. 1 is a section through apparatus in accordance with the present invention.
Figure 2:
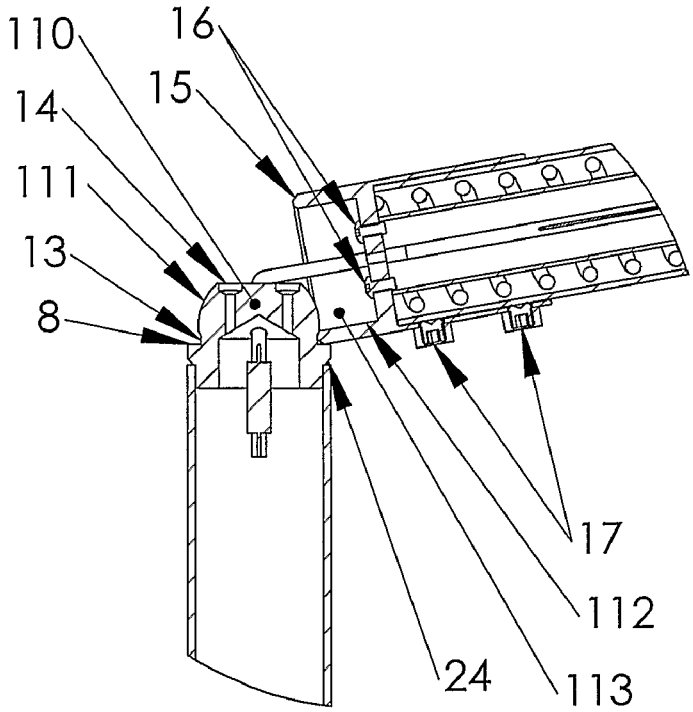
FIG. 2 is a detail of the apparatus of FIG. 1, operatively displaced.

The illustrated embodiment of FIGS. 1 and 2 has a 360° degree universal hinge arrangement defined between an upper post supporting post member 6 and a lower body member 10. The interaction between a spigot 110 having an annular, part spherical surface 111 and the inner wall 112 of a recess 113 that absorbs the initial shear forces of impact (protecting the cable & spring from excess stress) and forces the sign to rotate toward the ground from any angle of impact.

This induced rotation is designed to minimise the damage of impact to both post and vehicle. By inducing post rotation, the energy suddenly imparted to the post from the impact, causes the posts travel to the horizontal position faster, meaning it is clear from further impact as the car passes over.

This feature will minimise the scraping of the vehicle along the sign as it travels toward the horizontal, minimising the damage to both.

The spring 3 is used as the energy mechanism and has two key design features in addition to simply providing the self righting force. The spring 3 uses the lowest spring rating possible. This has the effect of minimising the force increase on the pivoting mechanism from the vertical to the horizontal position.

This means as the post pivots further toward the horizontal, the apparent force weight of the post or (moment of the post) increases at a greater rate to that of the spring force. The result of this is that the force acting on the post at horizontal is reduced and the spring appears to lose force as it pivots. (This is of course not the case; it is just a case of the two force systems coming closer to being balanced)

This effect reduces the speed and the force at which the sign post comes back up, so when a vehicle is travelling over the sign the force of the post hitting the underneath of the car from horizontal is greatly reduced, thus reducing the damage to both signage and vehicle.

The spring is held under a preload force when vertical. This force acts on the two flat surfaces 8 in creating a preload or initial resistance to motion off the horizontal. This feature increases the signs stability at the vertical position meaning it does not flutter from wind buffet. The preload is set to resist a bending moment equal to that induced by a 100 km/h wind impinging on a sign.

Two steel cables 114 are used as the force transmission elements and serve two key functions. The primary function of the cables is to transmit the force of the spring acting on the upper element to the lower element. The cables are always in tension. In the vertical the cables transmit the preload tension of the spring to the spigot forcing the mating faces at 8 together and thus providing initial resistance to rotation. During rotation of the post, the distance between the upper and lower elements increases. This causes the spring 3 to compress further as the length of cable available in the post is reduced. The cables equally transmit this force to the lower body member 10. The combination of this force and the fulcrum connection between the upper and lower elements creates the force moment needed to return the post to the upright position when unrestricted by external forces.

The two steel cables 114 are also spaced apart the maximum allowable distance when they pass through the upper 6 and lower 10 pivoting elements. This spacing allows the cables to act as the primary non rotation mechanism for the signage attached to the post. As the distance between the upper and lower elements decreases (i.e. as the post travels toward vertical), the un-captured cabling becomes shorter and therefore stiffer between the upper and lower elements acting more and more like a solid rod. This forces the upper and lower pivoting elements to realign to their original orientation as the post returns to vertical. (NOTE: it is mandatory that signage cannot rotate in situ and must return to its original rotation after any impact.)

The steel cable only acts as only the primary anti rotation mechanism, because it never becomes truly stiff enough to ensure a complete return to the original orientation. To ensure positive realignment two round protrusions 16 in the upper element 6 are included in the design to locate into two matching clearance holes 14 in the lower element. These elements only engage in the last few degrees of horizontal to vertical rotation after the cable has done the primary work. Theses protruded features and their mating capture holes guarantee accurate return to the original orientation.

The shape of the orientating protrusions 16 in this embodiment is very specific, so as the do not take any shear force that may occur in the initial impact whilst any clearances between the upper and lower elements are taken up. The shallow rounded head allows them slide up out of the mating clearance holes during any initial clearance take up.

The lower face 15 of the upper post holding element is chamfered on both sides. The flat face between these chamfer is used as the connection face at 8 to provide initial resistance to motion. The chamfers function in combination with the groove feature 13 running around the base of the spigot 110 act in combination while the upper mechanism is being pivoted to form a locked fulcrum point. The force of the spring counteracts the motion of the upper element and forces these two features together during rotation.

The chamfer and groove features interlock and work together to ensure the upper and lower elements act like a hinge in any direction (360°), meaning the upper element cannot slide up the rounded edge of the spigot and attempt to use the cable as a pivot fulcrum. If slippage was to occur, it one; may cause damage to the cable and two; reduce the effective spring force available to return the post to the upright position.

The large chamfering of the cable guide holes 7 on the lower face of the upper element are important features of this embodiment. In combination with smaller chamfering in the lower body element cable guide holes 9, these features in combination solve two key issues. They prevent the cable being squeezed and damage during the initial degrees of rotation of the upper element. Due to the geometry of the pivoting joint, there is insufficient clearance between the upper and lower elements, causing the cable to be squeezed and extruded to a degree. This squeezing has the effect of distorting the cable and fracturing the outer strands. Without these features the cable increasingly frays with every joint cycle and eventually fails.

The second function of the large countersinks in combination with the smaller countersinks on the matching lower element help prevent any cable shear that may occur from the lateral motion of the joint to take up any clearances between the upper and lower elements upon an initial impact.

A shock tube 4 is fitted over the cable and internal to the spring. The tubes primary function is to prevent over compression and resulting damage to the spring should the upper element 6 and post 5 get hooked on a vehicle undercarriage. The tube provides a mechanical stop at a set distance of spring travel.

The secondary function of the shock tube is to keep the spring straight when it is under compression, and not capture by the posts internal diameter. This feature is intended to facilitate the ease of quick post replacement by preventing the spring from forming its own random equilibrium shape when under tension.

In operation, two Steel cables (114) are threaded through mating holes in the lower body (10) and upper socket (6) pivoting elements. The cables are captured in the lower body (10) by either a loop (23) or swage (20).

The cables (114) pass up through the centre of the shock tube (4) and the spring (3). The cables (114) pass together through spring retaining plate (2) and are swaged at their end (22). The spring (3) is held in pre stressed compression by swage (21), leaving an inactive tail (1).

The post (5) is captured on its outside diameter by the upper element (6). Two grub screws (17) are screwed into the post (5) contacting, biting into and deforming the surface. The grub screws (17) push the opposite side of the post (5) into the capturing sleeve wall of (6), creating a clamp effect. The combination of the clamping effect and post (5) deformation provide sufficient force for the post to remain captured during an impact.

The compression in the spring forces faces 8 together, creating a preload effect that provides an initial resistance to moving off the vertical. The two protrusions elements (16) in the upper connection (6) are captured in the two locating holes (14) in the lower spigot element (10) maintaining a positive sign alignment.

As the top assembly is rotated the chamfered edges (15) of the upper socket element (6) engage and interlock into the annular groove (13). Coupled with the increasing force being induced by the springs (3), this action forms a pseudo locked hinge pin ensuring consistent operation and rotation characteristics in any angle of rotation. The interlocking effect also prevents the upper connection element (6) climbing up the side of the lower spigot element (10) potentially causing cable damage and effecting negatively on the fulcrum geometry.

Spring (3) is further compressed as the post (5) is forced toward the horizontal. The force is transferred to the lower spigot element (10) by the cable assembly (114).

Once released the post assembly (5) will travel back toward the vertical. As the upper assembly (5 & 6) approaches near vertical the spaced cables (114) force the post orientation back toward its original positions. In the last few degrees prior to vertical the protrusions (16) will engage with mating clearance holes (14) and positively position the post (5) assembly's rotation relative to sign direction.

There are two road connection options illustrated for the primary recovery post and a drivable in-ground option for a delineator/guide post.

Figure 4:
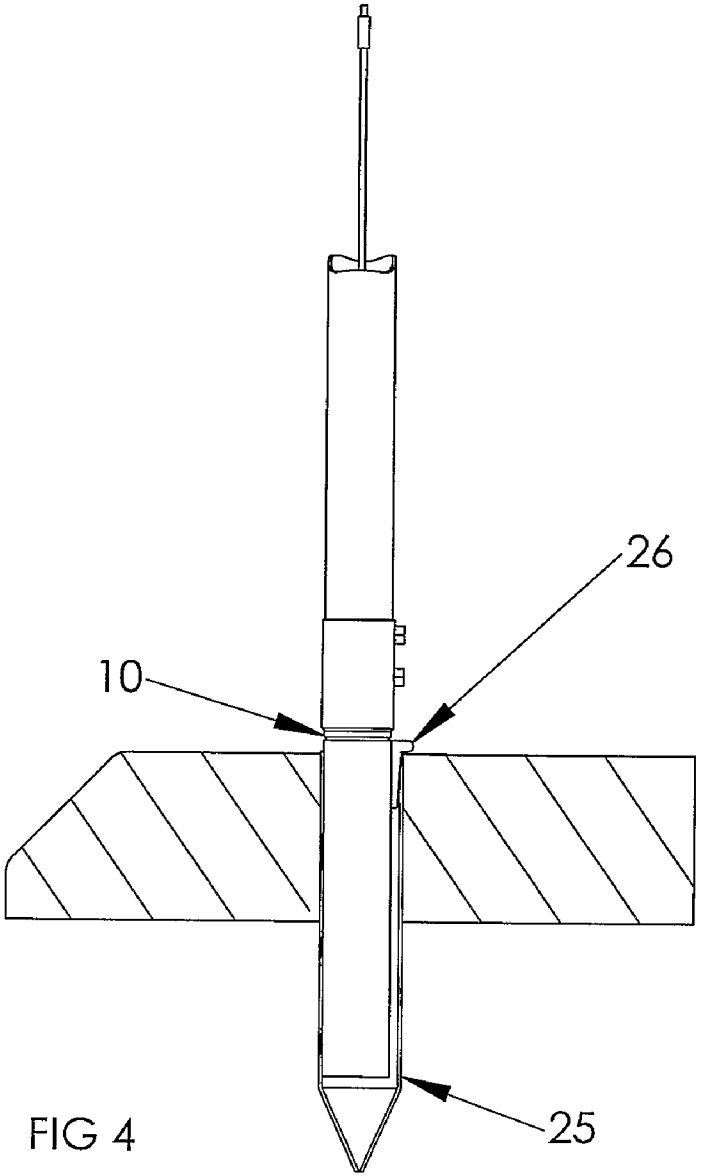
FIG. 4 is an alternative mounting means suitable for use with the apparatus of FIGS. 1 and 2.

The recovery post has two connection options. FIG. 4 illustrates an in-ground socket installation wherein a steel pipe section is welded to the lower spigot connection element (10). A clearance groove, (24) in FIG. 2, is used to accommodate weld penetration and is part of the lower spigot element. This assembly fits into a pre-existing road island ground sleeve (25) and is secured in place by a wedge (26).

Figure 3:
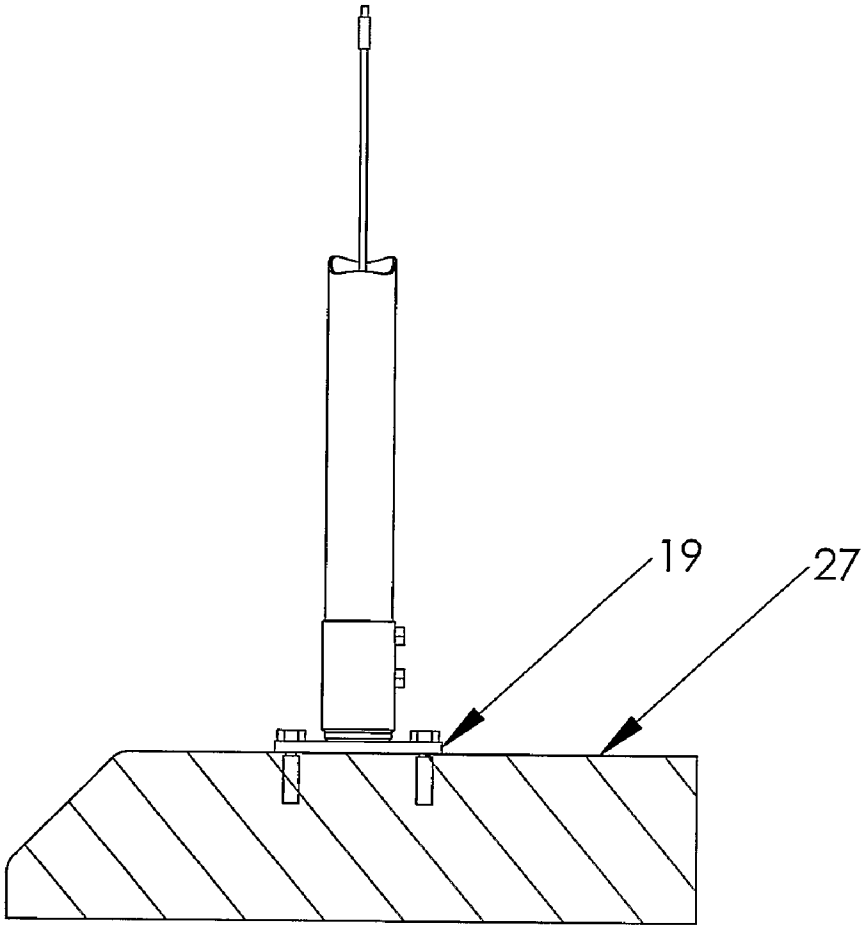
FIG. 3 is a bolt-down mounting means suitable for use with the apparatus of FIGS. 1 and 2.

A surface mount installation is illustrated in FIG. 3, wherein a steel base plate (19) is welded to the lower spigot connection element (10). A clearance groove (FIG. 2 item 24) is used to accommodate weld penetration and is part of the lower spigot element. This assembly bolts onto a pre-existing road island (27) using appropriate anchor bolts.

Figure 8A:
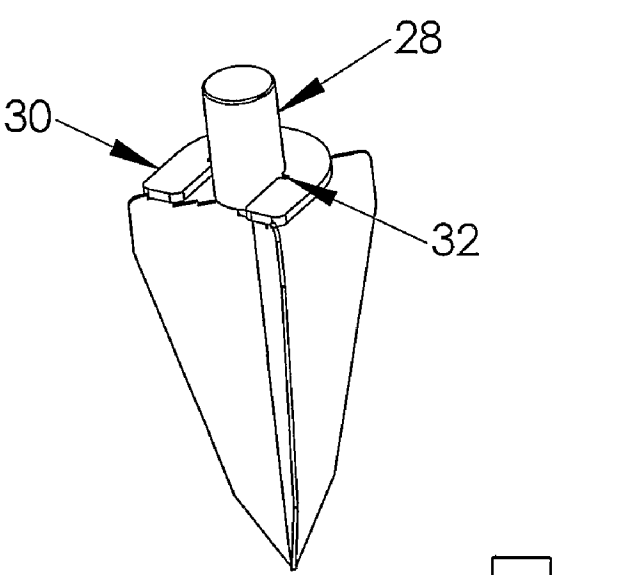
FIGS. 8A and 8B are a perspective and elevation respectively of a detachable/drivable in-ground spike driving tool system for use on the apparatus of FIG. 7.
Figure 8B:
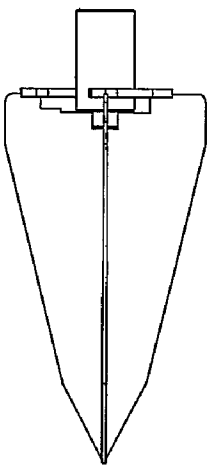
Figure 7C:
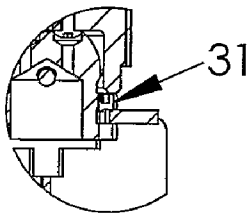
FIGS. 7A to 7C are a perspective, elevation and partial section respectively of a detachable/drivable in-ground spike mounting for apparatus in accordance with the present invention.
Figure 7B:
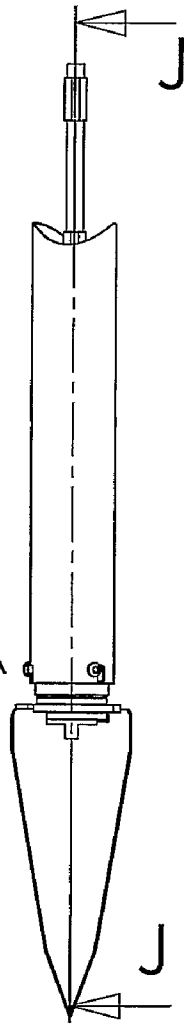
Figure 7A:
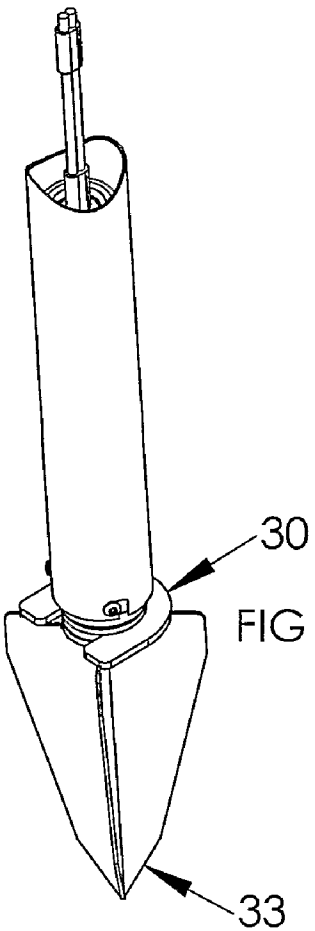
Figure 9A:
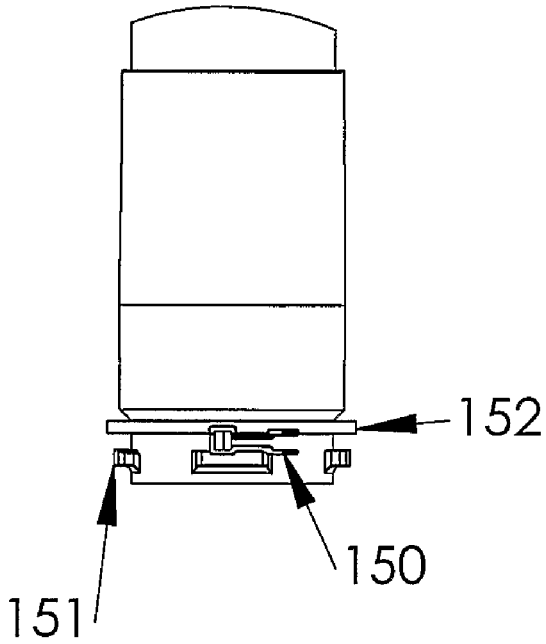
FIGS. 9A to 9D are an elevation, bottom plan, vertical section and base elevation of an alternative quick-release embodiment of the present invention.
Figure 9C:
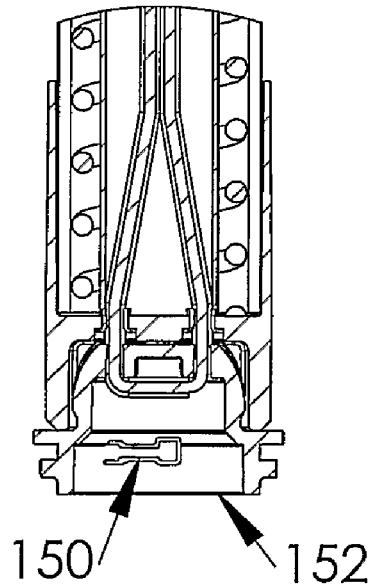
Figure 9B:
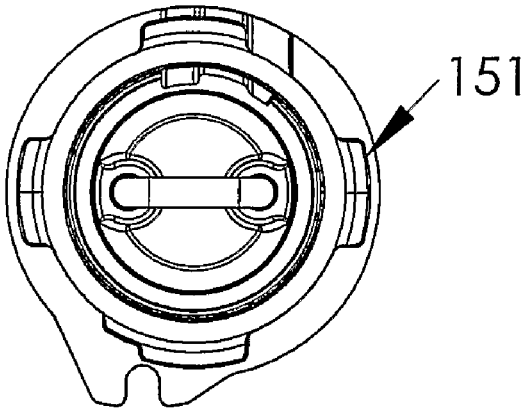
Figure 9D:
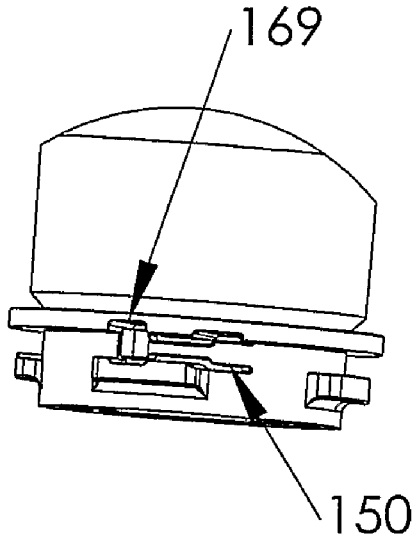

In the embodiment of FIGS. 7 and 8, a guide post utilises a drivable in-ground spike (33), installed via a manual hammer dolly 28 or a jack hammer dolly. A feature of this in-ground spike is to allow in situ delineator change over without having to remove the spike from the ground or indeed drive in a new one.

In the embodiment of FIG. 6, there is illustrated a quick release post suitable for use with the base of FIGS. 7 and 8, and wherein the lower spigot element (10*a*) is modified to include a groove feature 29. This groove (29) slides into the horse shoe shaped plate (30). The lower spigot connection (10*a*) is locked into position and prevented from sliding out by tightening two grub screws (31) that locate into two matching groove features (32) in the plate (30).

Quick guide post assembly change is performed without having to remove the spike (33) from the ground by simply loosening the two screws (31) and sliding (10*a*) off the horse shoe plate (30). A new post is slid over the horse shoe plate (30) and locked into position by tightening the two screws (31)

FIGS. 1, 5 and 6 provide for post connection options. An outside sleeve external post diameter capturing option for the island based road sign product is provided wherein the post (5) is captured on its outside diameter by the upper element (6). Two grub screws (17) are screwed into the post (5) contacting, biting into and deforming the surface. The grub screws (17) push the opposite side of the post (5) into the capturing sleeve wall of (6), creating a clamp effect. The combination of the clamping effect and post (5) deformation provide sufficient force for the post to remain captured during an impact.

An internal post diameter capturing bolted option with a quick release feature, aimed at the delineator/guide post market. The quick release system is designed to allow quick in situ post replacement without the need to replace the entire pivoting assembly. The diameter (37) of the upper socket element (6*a*) is varied by machining to suit the type and size of post (5*a*). Post (5*a*) has three equi-spaced hockey stick type features (35) in its lower portion. The post (5*a*) is slid down over the upper element diameter (37) until the hockey stick grooves (35) engage the three equi-spaced Screws (36). Once the grooves (35) are bottomed on the screws (36) the post is rotated around the vertical axis until the extremity of the horizontal portion of the groove (35) engages the screws (36). The three screws (36) can then be tightened securing the post (5*a*). Reverse the above procedure to remove a post (5*a*).

In the embodiment of FIGS. 11A and B there is illustrated a drivable in-ground spike 155, installed via a manual hammer driver 159 or a jack hammer driver. The driver 159 twists and locks into the ground spike capture ring 156 using a spring loaded latch 160 that engages locking feature 167. Once locked the two components are held together rigidly acting as one component. This allows the driver 159 to be used both as an installation driving tool and also a vertical alignment tool. To release the driver 159 the spring loaded latch 160 is pushed back and the driver is twisted in the reverse direction out of the capture ring. The engagement plate 170 carries the same single elongated lug feature 165 as the lower spigot 150 to ensure connection orientation between the driver 159 and the in ground spike 155 is the same as that of the in ground spike 155 and the lower spigot 152.

A feature of this in-ground spike is to allow in situ delineator change over without having to remove the spike from the ground or indeed drive in a new one.

Quick guide post assembly change is performed without having to remove the spike 155 from the ground by depressing clip 150 with a screwdriver or similar and twisting the lower spigot 155 out of the capture ring 156. A new post assembly is installed by engaging the lower spigot 152 into the capture plate 156, and twisting the post assembly until the clip 150 engages into feature 167.

In the embodiment of FIGS. 9 and 10, there is illustrated an embodiment optimised for manufacture in plastics and wherein a lower spigot 152 has four capture tabs 151 that feed through the clearance slots of the in a capture ring 156 of a ground spike. There is a feature on one of the tabs 165 that extends that particular tabs length. This corresponds to an elongated clearance groove 166 in the capture ring 156. This means the lower spigot can only be fed into the capture ring in the correct orientation.

Once the lower spigot 152 is fitted through the capture ring 156 it needs to be twisted 45 degrees until it locks into place. The locking mechanism consists of two separate features working together. The first feature is the stop lug 158 that prevents rotation past the 45 degree twist. At the 45 degree twist point the clip 150 which has been flexed inward by the internal surface 168 of the ring 156, is allowed to spring back out and is capture by the groove feature 167. Further rotation in either direction is prevented by both the engagement of stop lug 158 which rests against the end of feature 166 and the clip 150 which is captured in feature 167.

To remove the lower spigot from the capture ring requires a screw driver or similar to be inserted through and access slot 169 between the capture ring 156 and lower spigot 152. The clip 150 is pushed back by the screwdriver releasing it from groove feature 167 and freeing the lower spigot to twist back out the opposite way to which it was engaged. This arrangement may also be used in a surface mount system.

Figure 12A:
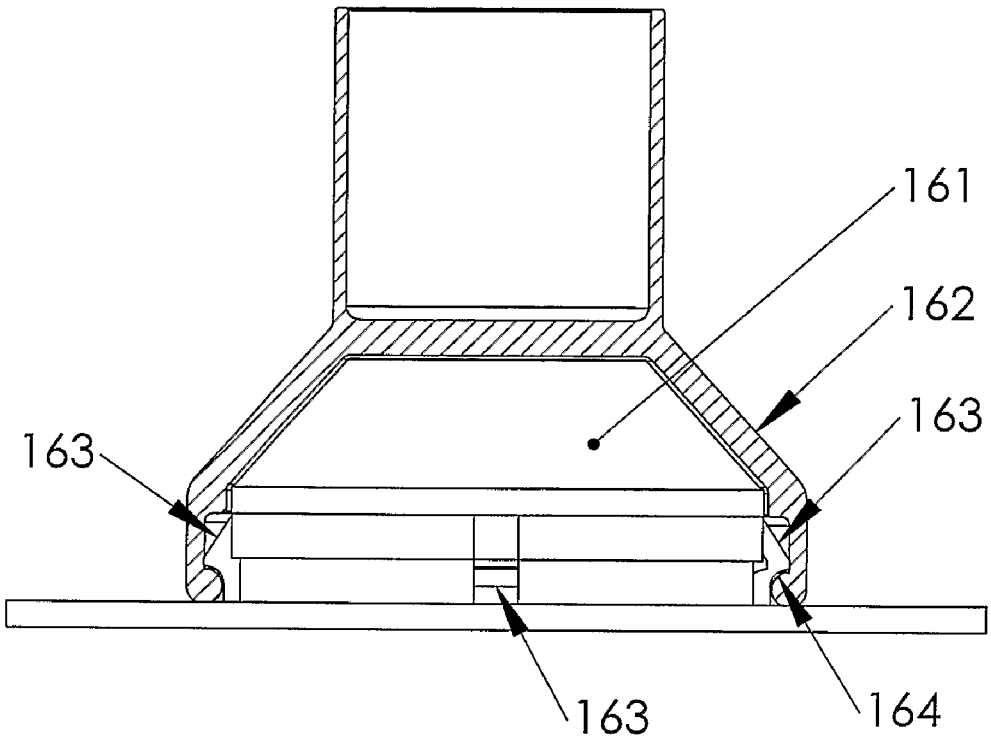
FIGS. 12A and 12B are vertical sections through an alternative knock down post system.
Figure 12B:
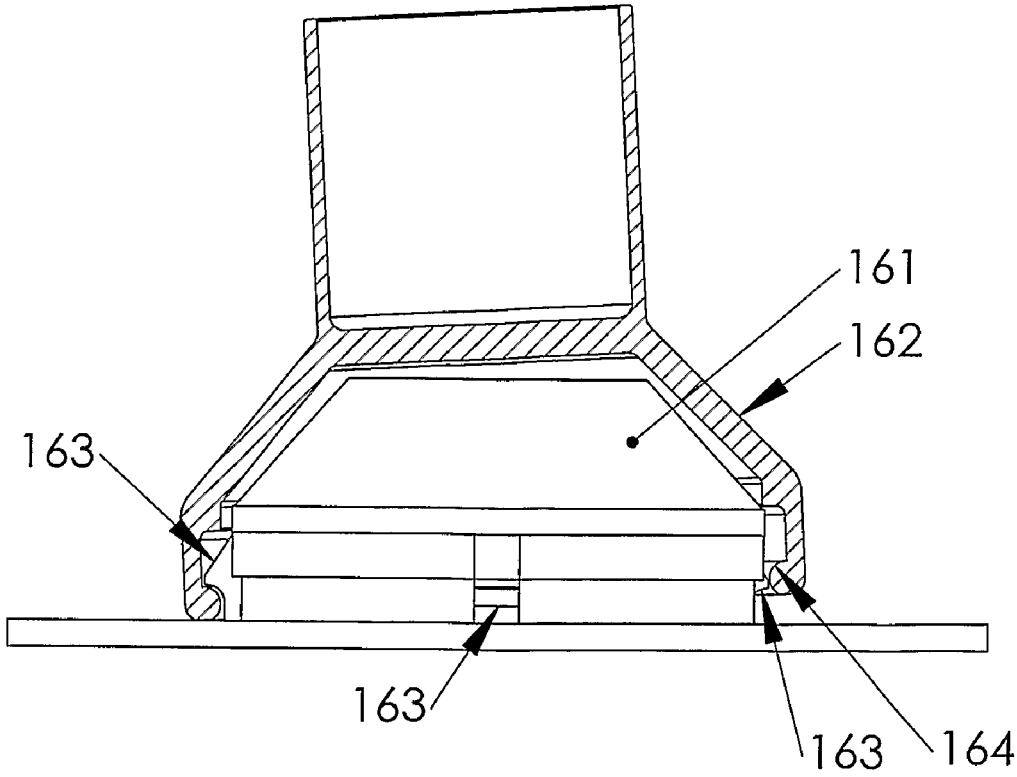

In the embodiment illustrated in FIG. 12, there is provided a system suitable for use in taller that average guide/delineator post systems, for example to 2.8 m. The current tallest is 1600 mm. To combat wind flutter there are provided 4 off equi-spaced spring loaded detent latches 163. A ledge feature 164 around the base of the top sleeve 162 is captured by a matching shape in the detent latch 163. As the angle of capture is obtuse then the force to push the detent latch back to allow the top sleeve 162 to begin disengaging the lower spigot 161 is very high. The return angle on the detent latch 163 is acute and hence the force required for the ledge 164 to push back the detent latch on re engagement is quite low. This ensures the main compression spring 3 picking up the post has sufficient force to re engage the ledge 164 with the detent latch 163.

This detent system gives a high force requirement to disengage (ie good resistance to wind flutter) prior to a collision. Once disengaged the increased leverage system allows use of a weaker spring to perform the recovery of the post. The return path of the top sleeve back over the lower spigot and detents is via an engagement angle acute enough to ensure the main spring pressure 3 is sufficient to re engage the detent latches once the post is upright again.

The base design philosophy for the foregoing embodiments was to provide a spring back sign post system that will stand back upright after being hit at speed. The system is designed to use an on site replaceable common 50 NB steel post 1600 mm high. Thus means it can also use the standard signage sizes and standard sign fittings currently in use. The invention may also be used in long-post applications with appropriate selection of modifications.

The exemplified apparatus allows for onsite post replacement, if damaged. It uses a steel pivoting mechanism. The apparatus will resist wind speeds in excess of 100 km/h before moving or fluttering off the vertical position.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

The invention claimed is:

1. A knock down signpost including:

a lower body member having an annular bearing surface bounding a spigot portion;

a post member having a lower annular edge corresponding to said annular bearing surface and bounding a recess adapted to receive said spigot portion, said spigot portion and recess being mutually configured to allow an articulation of said post member about an engagement of said lower annular edge and annular bearing surface in any direction, at least one of the spigot portion and recess including means for constraining initial impact movement of the post member to minimize lateral displacement;

a pair of spaced, flexible cables passing through said lower body member and said post member, one end of each cable of said pair of cables being retained in one of said lower body member and said post member and said cables being pretensioned by tension means located in the other of said lower body member and said post member to urge said lower body and post members into mutual engagement against said articulation and providing primary circumferential alignment between said lower body member and said post member; and said post member comprising at least two round protrusions located radially inside an outer circumference of said post member and avoiding contact with an outer circumference of said lower body member, said at least two round protrusions depending from said lower body member and configured to be received in two clearance holes in said spigot portion such that when said post member rotates toward a vertical alignment in response to said cables urging said post member against said articulation said at least two round protrusions are received in said clearance holes to cause a complete return of said post to an original circumferential alignment prior to said articulation.

2. The knock down sign post according to claim 1, wherein said means to constrain initial impact movement includes an annular, part spherical surface on the spigot portion of dimensions selected whereby an inner annular surface of the post member bounding the recess in the region of the lower annular edge is constrained to follow the part spherical surface for an initial displacement of 5 to 10° until the lower annular edge is fully engaged with the bearing surface for rotation.

3. The knock down sign post according to claim 2, wherein the annular, substantially part spherical surface extends about the hemispheric plane of the notional sphere defining the surface.

4. The knock down sign post according to claim 3, wherein said post is a 50 mm NB post member, and the hemispheric plane passes 5 to 10 mm above the plane of interaction of the lower annular edge and annular bearing surface.

5. The knock down sign post according to claim 1, wherein the bearing surface comprises an annular, curved surface and the lower edge is correspondingly rounded.

6. The knock down sign post according to claim 1, further comprising a longitudinal axis, wherein each of said spaced cables are disposed equidistant the longitudinal axis.

7. The knock down sign post according to claim 6, wherein the pair of cables pass through individual guide holes in the lower body and upper wall of the recess respectively.

8. The knock down sign post according to claim 7, wherein the guide holes are relieved or chamfered to prevent the pair of cables being squeezed and damage during the initial degrees of rotation of the post member.

9. The knock down sign post according to claim 8, wherein there is larger chamfering of the cable guide holes on upper wall of the recess and smaller chamfering in the lower body cable guide holes.

10. The knock down sign post according to claim 1, wherein the tension means is selected from a group consisting of elastomeric, metal and air springs.

11. The knock down sign post according to claim 10, wherein the tension means is a coil spring of metal of the lowest spring rating consistent with recovering the post to the vertical position.

12. The knock down sign post according to claim 11, wherein a shock tube is fitted over the cable and internal to the spring to prevent over compression thereof.

13. The knock down sign post according to claim 1, wherein the pretension is set to resist a selected bending moment equal to that induced by a 100 km/h wind impinging on the sign.

14. The knock down sign post according to claim 1, wherein said lower body member is plastic and includes a multi-tab bayonet twist and lock system having a lower spigot portion including capture tabs for engagement with clearance slots of a capture ring associated with ground engagement means.

15. The knock down sign post according to claim 14, wherein said ground engagement means is selected from a group consisting of a mounting plate and an in-ground spike.

16. The knock down sign post according to claim 15, further comprising a guide post/delineator, wherein said multi-tab bayonet twist and lock system is adapted whereby the lower spigot portion can only be fed into the capture ring in the correct orientation for the guide post/delineator.

17. The knock down sign post according to claim 16, and including a locking means for retaining said lower body member when said bayonet twist and lock system is in its engaged position.

18. The knock down sign post according to claim 1, further comprising a sleeve, wherein the diameter of the sleeve and spigot portion are selected relative to the post length to match the moment balance equation equal to a given spring, and wherein a long-post windage is provided with a plurality of equally spaced spring loaded detent latches to provide a selected initial resistance to movement.

19. A knock down signpost including:

a lower body member having an annular bearing surface bounding a spigot portion;

a post member having a lower annular edge corresponding to said annular bearing surface and bounding a recess adapted to receive said spigot portion, said spigot portion and recess being mutually configured to allow an articulation of said post member about an engagement of said lower annular edge and annular bearing surface in any direction, at least one of the spigot portion and recess including means for constraining initial impact movement of said post member to minimize lateral displacement;

a pair of spaced, flexible cables passing through said lower body member and said post member, one end of each cable of said pair of cables being retained in one of said lower body member and said post member and said cables being pretensioned by tension means located in the other of said lower body member and said post member to urge said lower body and post members into mutual engagement against said articulation and providing primary circumferential alignment between said lower body member and said post member;

complementary indexing means associated with said spigot portion and recess to complete circumferential alignment between said lower body member and said post member on elastic recovery of said post member in response to said cables urging said post member against said articulation, said complementary indexing means including at least two round protrusions in the recess adapted to locate into two matching clearance holes in the spigot portion and adapted to engage in the last few degrees of horizontal to vertical rotation after the cables have done the primary work; and a plurality of equally spaced spring loaded detent latches located on an outer surface of said lower body member engaged with a ledge located on an inner surface of said post member to provide a selected initial resistance to said articulation of said post member.

* * * * *